US005809676A

United States Patent [19]

Sukumoda et al.

[11] Patent Number: 5,809,676

[45] Date of Patent: Sep. 22, 1998

[54] SIGN DISPLAY APPARATUS

[75] Inventors: Katsuyuki Sukumoda; Tatsuya Okonogi; Yukio Yoshikawa, all of Tokyo, Japan

[73] Assignee: Copal Company Limited, Tokyo, Japan

[21] Appl. No.: 638,013

[22] Filed: Apr. 25, 1996

[30] Foreign Application Priority Data

Apr. 28, 1995 [JP] Japan ..... 7-105248
Mar. 18, 1996 [JP] Japan ..... 8-060918

[51] Int. Cl.[6] ..... G09F 3/04

[52] U.S. Cl. ..... 40/452; 40/541

[58] Field of Search ..... 40/452, 541

[56] References Cited

FOREIGN PATENT DOCUMENTS 6-222722 8/1994 Japan .
7-239664 9/1995 Japan .
7-261682 10/1995 Japan .
7-261698 10/1995 Japan .

*Primary Examiner*—Cassandra H. Davis
*Attorney, Agent, or Firm*—Merchant, Gould, Smith, Edell, Welter & Schmidt

[57] ABSTRACT

A plurality of sign display units are arranged adjacent to each other along at least one surface in order to form a convex or concave arc curved surface curved with a predetermined radius. In each sign display unit, light-emitting elements are arranged in a dot matrix so as to be able to display a kanji character, a high-quality alpha-numeric character close to a printing type, or an image, thus displaying desired sign information. The sign display unit provides good readability while its visual field angle is increased without degrading the display quality.

20 Claims, 15 Drawing Sheets

SIGN DISPLAY APPARATUS

BACKGROUND OF THE INVENTION

The present invention relates to sign display apparatus used for various types of sign displays and, more particularly, to sign display apparatus which is used in the form of a plurality of units arranged along, e.g., a horizontal surface for a sign display on a display surface other than a flat surface.

In various types of public facilities and railway or road facilities, sign display apparatuses have come into wide use which display desired sign information continuously and stationarily, or in a scrolling manner. According to such a sign display apparatus, a desired number of sign display units are prepared each of which has a matrix of, e.g., 16 dots×16 dots or more in the vertical and horizontal directions so as to allow the display of kanji characters on a flat display surface. These sign display units are arranged with no space between them, thereby constituting a flat display surface.

In large sign display apparatuses in various kinds of large public facilities, an apparatus which can display natural colors by mixing three primary colors has also been put into practice. Also in this large sign display apparatus, for example, a desired number of sign display units are prepared to have a flat display portion in the vertical and horizontal directions, and these sign display units are arranged with no space between them, thereby constituting a flat display surface.

However, since the aim of the sign display units described above are to form a flat display surface, if they are used to form other surfaces, e.g., an annular curved display surface, spaces are formed among the arranged units, resulting in a degradation in display quality.

More specifically, referring to the plan view of FIG. 15 in which conventional sign display units are arranged on a convex arc having a radius R, sign display units 101 integrally formed with driving circuits 106 respectively are arranged along the arc surface. In this case, since the display surfaces of the respective sign display units 101 are flat, spaces S are formed between the bonding surfaces to become unnecessary spaces between display units, thereby degrading the display quality. Also, the visual field angle A is decreased, as shown in FIG. 15, and when the radius R is small, the display quality is greatly degraded.

Although not shown, when sign display units are arranged on a concave arc having a radius R, no unnecessary spaces are formed between display units. However, as the respective display surfaces are flat, they degrade the entire display quality.

Thus, in a large sign display apparatus as described above, a desired number of sign display units having flat display portions are arranged with no spaces among them. If the sign display units are arranged along a curve, they degrade the display quality. In particular, when the radius R of the curve is small, the display quality is greatly degraded. Therefore, no commercially available large sign display apparatus having a curved display surface has been put into practice.

SUMMARY OF THE INVENTION

The present invention has been made in consideration of the above problems, and has as its object to provide a sign display unit in which, when it is used in the form of a plurality of units arranged adjacent to each other along at least one surface to form a convex or concave arc curved surface with a predetermined radius, thus displaying desired sign information, good readability is provided by increasing the visual field angle without degrading the display quality.

It is another object of the present invention to provide a sign display unit in which, even when it is used in the form of a plurality of units arranged adjacent to each other along at least one surface to form a convex or concave annular curved surface with an arc with a radius of 10 cm or more, desired sign information including kanji characters, characters close to printing types, and images with a visual field that can be viewed from angle of 360° can be displayed without degrading the display quality, and the constituent components including reflectors can be manufactured at a low cost.

It is still another object of the present invention to provide a sign display unit that can effectively reproduce colors obtained by mixing with light-emitting elements of different colors while providing good readability by increasing the visual field angle without degrading the display quality.

It is still another object of the present invention to provide a sign display unit in which, when it is used in the form of a plurality of units arranged adjacent to each other along at least one surface to form an convex or concave arc curved surface into an arc with a predetermined radius, thus electrically displaying desired information, good readability is provided by increasing the visual field angle without degrading the display quality, the constituent components of can be manufactured at a low cost, and the manufacturing cost can be decreased.

In order to solve the above problems and to achieve the above objects, according to the present invention, there is provided a sign display unit used in the form of a plurality of units arranged adjacent to each other to form a display surface having a concave or convex curved surface of second degree, comprising a frame base portion, a mounting board having light-emitting elements mounted thereon which are used for a sign display of a predetermined dot matrix, a curved member having curved surface and fixed to the frame base portion, and a circuit board fixed to the frame base portion to control light emission of the light-emitting elements.

According to the present invention, there is also provided a sign display unit used for a sign display in the form of a plurality of units arranged adjacent to each other along at least one surface to form a curved surface having circular inner and outer circumferential surfaces with a radius of 10 cm or more, comprising a frame base portion, a flexible mounting board on which light-emitting elements corresponding to a dot matrix that can display at least one kanji character are mounted equally in vertical and horizontal directions in a matrix and which is deformed along the curved surface, an aluminum curved plate member which fixes the mounting board along the curved surface in tight contact through a silicone resin layer or a silicone rubber sheet having both thermal conductivity and electrical insulation, has a flat fixing portion to fix a circuit board, and dissipates heat generated by the light-emitting elements, the circuit board being connected to the mounting board to drive the light-emitting elements in a predetermined manner, and fixing means for fixing a reflector on the mounting board, the reflector having a concave reflecting surface formed in correspondence with the light-emitting elements mounted on the mounting board, wherein the reflector is dividedly formed with members each having a width obtained by dividing an entire length of the mounting board along the surface by an integer, and the reflector is injection-molded of a predetermined resin material such that the reflecting surface is prevented from becoming an under portion in a mold.

According to the present invention, there is also provided a sign display unit used for a sign display in the form of a plurality of units arranged adjacent to each other in vertical and horizontal directions along at least one surface to form a convex or concave arc or circular curved surface curved with a predetermined radius, thus forming a multi-color display surface, comprising a flexible mounting board on which light-emitting elements are mounted in the vertical and horizontal directions in a matrix to display dots in a predetermined unit of display and to emit light of predetermined colors and which is deformed along the curved surface, a curved member which fixes the mounting board along the curved surface in tight contact through a heat-conductive insulating layer or a heat-conductive insulator having both thermal conductivity and electrical insulation, and which dissipates heat generated by the light-emitting elements, and a circuit board connected to the mounting board to drive the light-emitting elements in a predetermined manner, wherein the light-emitting elements include a plurality of light-emitting elements of different colors mounted at respective dots, two light-emitting elements are mounted at upper and lower portions substantially perpendicular to the surface such that wires that connect the light-emitting elements are directed in opposite directions, two light-emitting elements are mounted at upper and lower oblique portions with respect to the surface such that wires that connect the light-emitting elements are directed to face each other along the surface, two light-emitting elements are mounted at each of the upper and lower portions substantially perpendicular to the surface such that upper and lower wires that connect the light-emitting elements are directed in the opposite directions, two light-emitting elements are mounted at upper and lower oblique portions with respect to the surface such that wires that connect the light-emitting elements are directed in directions substantially perpendicular to the surface, two light-emitting elements are mounted at each of the upper and lower portions substantially perpendicular to the surface and upper and lower wires that connect the light-emitting elements at upper and lower oblique portions with respect to the surface are directed obliquely with respect to the surface, or two light-emitting elements are mounted at each of the upper and lower portions substantially perpendicular to the surface and the upper or lower wires that connect the light-emitting elements are directed to oppose each other along the surface, and the colors are mixed.

According to the present invention, there is also provided a sign display unit used in the form of a plurality of units arranged adjacent to each other to form a display surface having a concave or convex curved surface of second degree, comprising a frame base portion, a flexible mounting board on which light-emitting elements used for a sign display of a predetermined dot matrix are mounted in vertical and horizontal directions and which is deformed along the curved surface of second degree, a curved member having the curved surface of second degree and fixed to the frame base portion, the curved member serving to fix the mounting board in tight contact through a heat-conductive insulating layer or a heat-conductive insulator having both thermal conductivity and electrical insulation, thereby dissipating heat of the light-emitting elements, a circuit board connected to the mounting board to drive the light-emitting elements in a predetermined manner and fixed to the frame base portion, and a reflector which is formed separately with unitary portions each having a width obtained by dividing a length of the curved surface of second degree along the curved surface by an integer in order to injection-mold the reflector having a reflecting surface corresponding to the light-emitting elements of a predetermined resin material, so that the reflecting surface is prevented from becoming an under portion in a mold, the reflector being integrally molded with coupling portions coupling the unitary portions.

According to the present invention, there is also provided a sign display unit used in the form of a plurality of units arranged adjacent to each other to form a display surface having a shape of a concave or convex polygon, the plurality of units corresponding to respective sides of the polygon, comprising a frame base portion, a flexible mounting board on which light-emitting elements used for a sign display of a predetermined dot matrix are mounted in vertical and horizontal directions and which is deformed along the respective sides, a curved member having the display surface and serving to fix the mounting board in tight contact through a heat-conductive insulating layer or a heat-conductive insulator having both thermal conductivity and electrical insulation, thereby dissipating heat of the light-emitting elements, a circuit board connected to the mounting board to drive the light-emitting elements in a predetermined manner and fixed to the frame base portion, and a reflector which is dividedly formed separately with unitary portions each having a width corresponding to a width of each of the respective sides in order to injection-mold the reflector having a reflecting surface corresponding to the light-emitting elements of a predetermined resin material, so that the reflecting surface is prevented from becoming an under portion in a mold, the reflector being integrally molded with coupling portions coupling the unitary portions.

Other features and advantages of the present invention will be apparent from the following description taken in conjunction with the accompanying drawings, in which like reference characters designate the same or similar parts throughout the figures thereof.

It should be noted that the present invention is not limited to the embodiments to be described below and that various arrangements can be made as suggested by the appended claims and accompanying drawings.

DETAILED DESCRIPTION OF THE PREFERRED EMBODIMENTS

Figure 1:
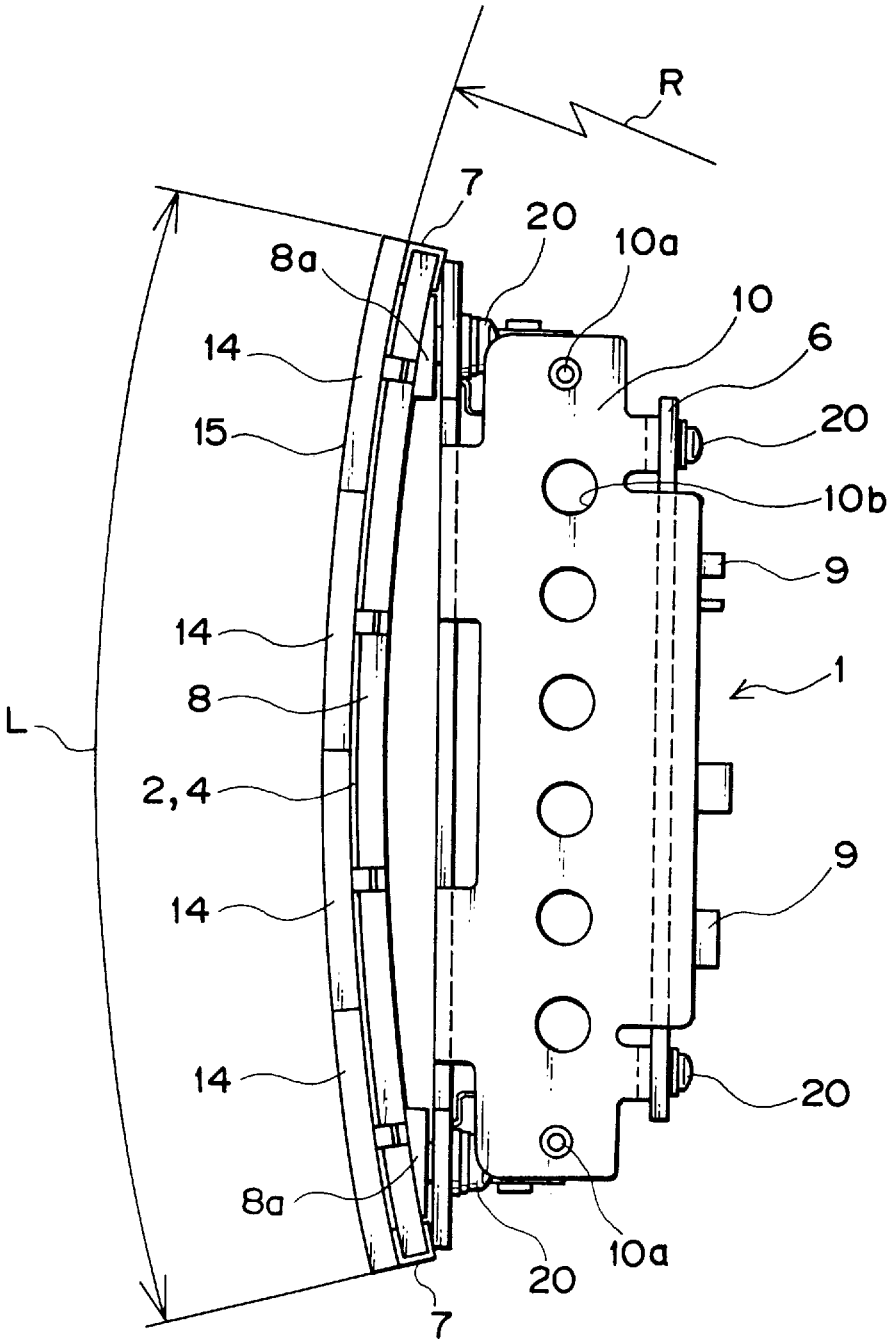
FIG. 1 is a top view of a sign display unit which has common parts to the respective embodiments.
Figure 2:
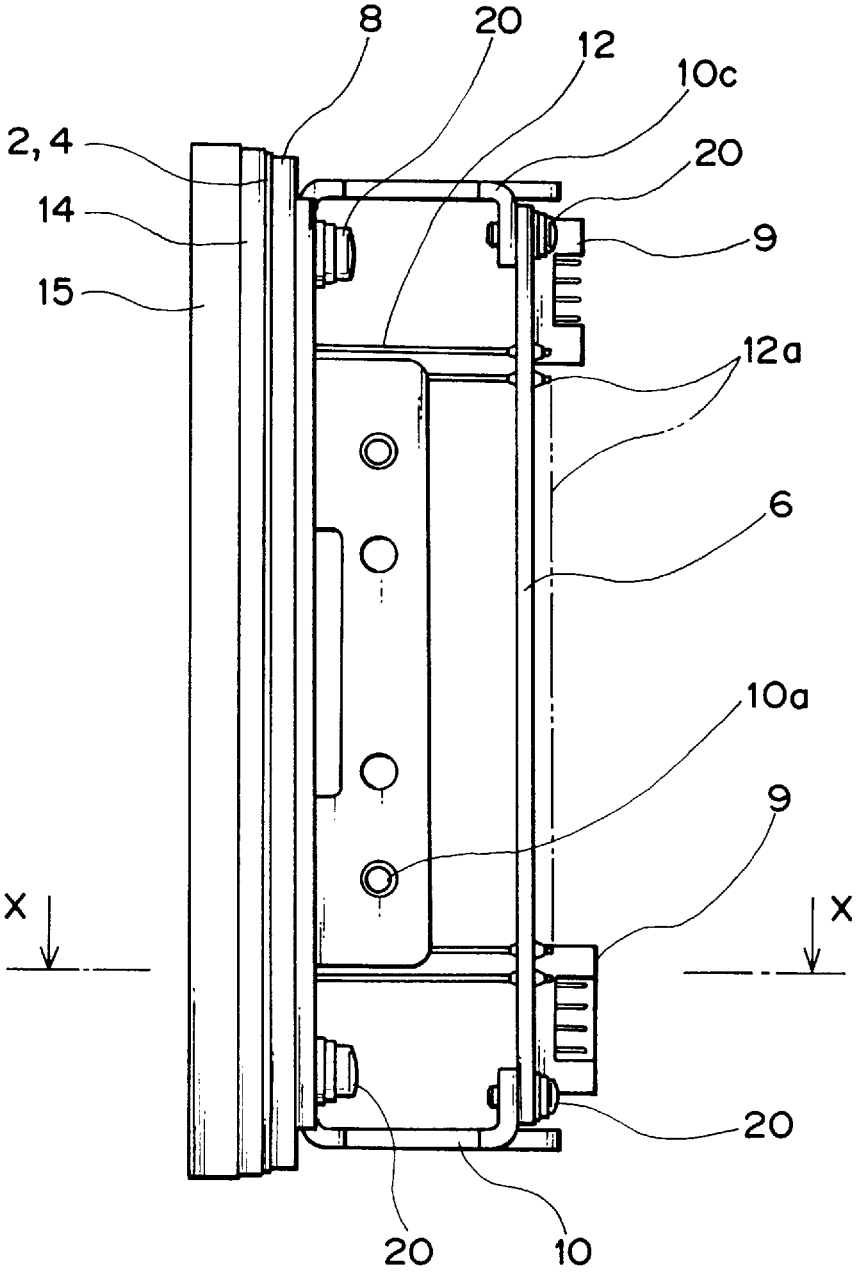
FIG. 2 is a side view of the sign display unit which has common parts to the respective embodiments.
Figure 3:
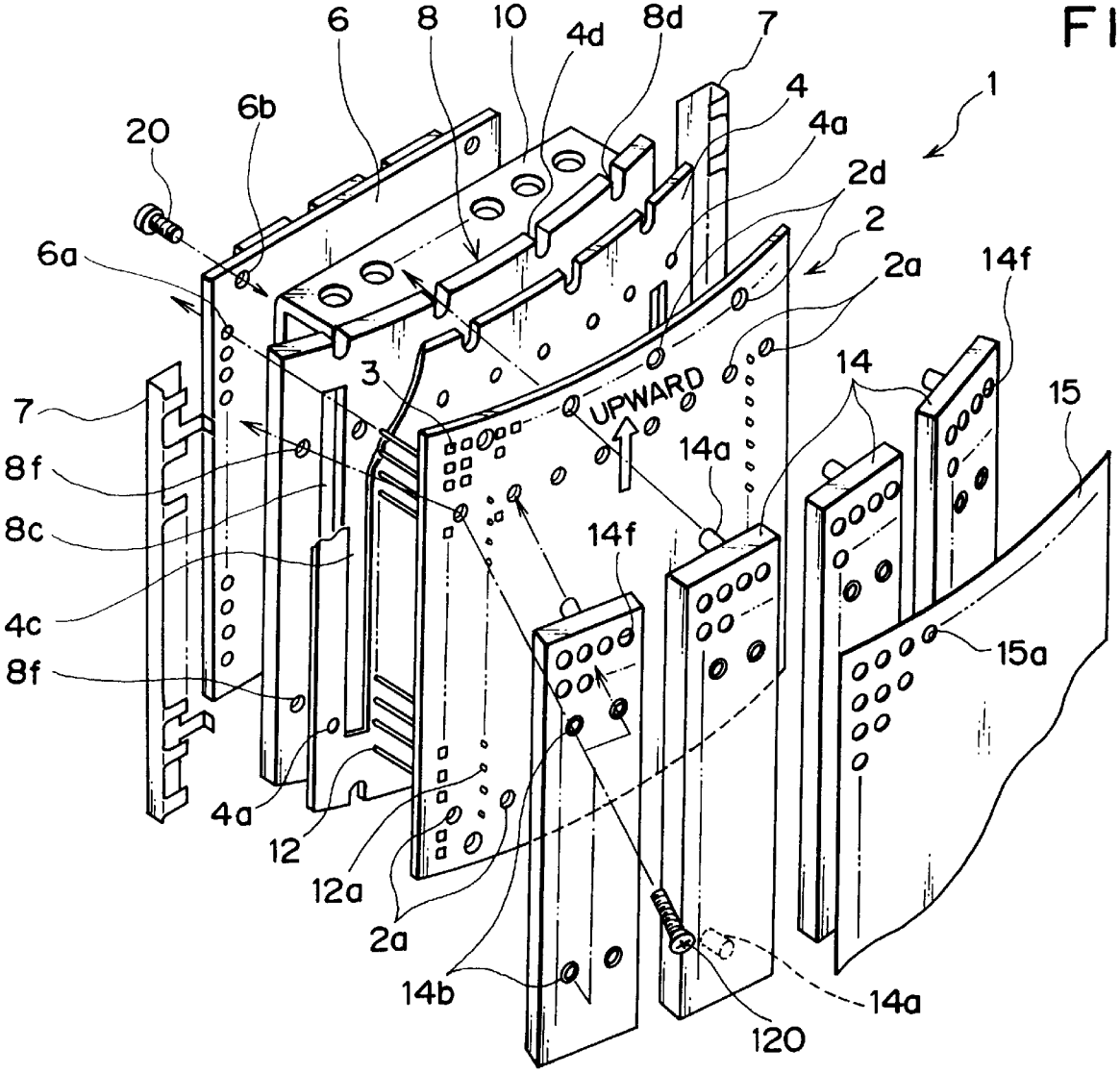
FIG. 3 is an exploded perspective view of the sign display unit which is common to the respective embodiments.
Figure 4:
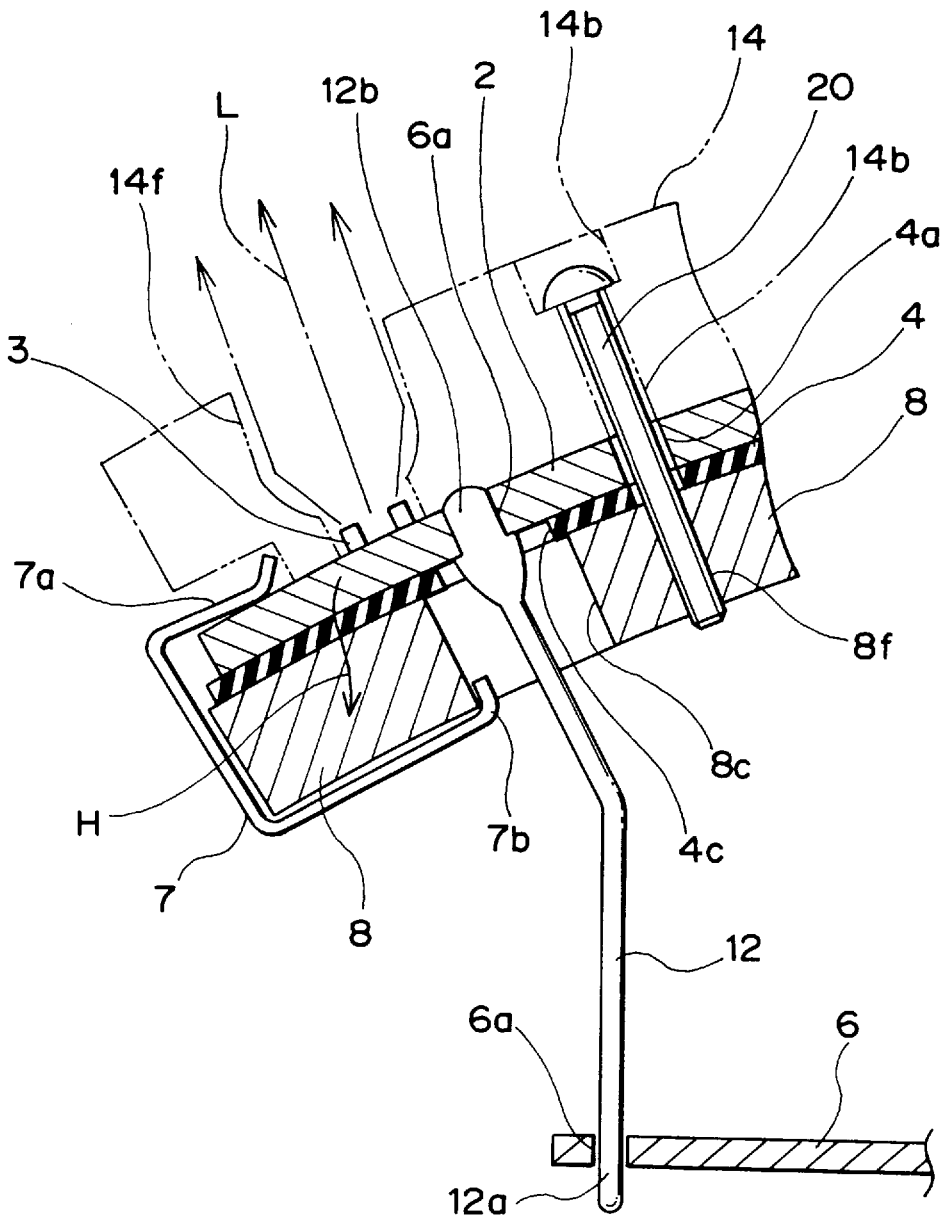
FIG. 4 is a sectional view taken along the line 4—4 of FIG. 2.

The preferred embodiments of the present invention will be described with reference to FIG. 1 showing a plan view of a sign display unit which is almost common to the respective embodiments, FIG. 2 showing a side view of the sign display unit which is almost common to the respective embodiments, FIG. 3 showing an exploded view of the sign display unit which is shown in FIGS. 1 and 2, and FIG. 4 showing a sectional view taken along the line 4—4 of FIG. 2.

Referring to FIG. 1, a sign display unit 1 has a width L determined by $2\pi R \div n = L$ (equation 1) so that n sign display units 1 can be disposed circularly.

Hence, one sign display unit 1 can display a kanji character or an alpha-numeric character close to a printing type corresponding to a 16×16-dot matrix. In order to realize a display with a full visual field angle of 360° by using a total of 16 sign display units 1, assuming each unit has a width L along the arc (the vertical size is also L since most of the sign display units 1 are square) of 96 mm, the radius R is determined by $R = Ln \div 2\pi$ (equation 2) from the equation 1. In this case, the actual value of the radius R is 244.6 mm. An appropriate sign display apparatus or a sign-board having a diameter of about 50 cm can thus be made.

In order to display the electric sign board completed in this manner in a store, it is hung from the ceiling or is installed by providing a pillar at its center. The width L of each sign display unit 1 can be appropriately set and is not limited to the value described above, as a matter of course. Also, the visual field angle is not limited to 360°. If the visual field angle is set to 180°, 270°, or the like, the sign-board can be mounted on a wall surface directly, as a matter of course.

Referring to FIGS. 1 and 3, in order to form an arc curved surface on the annular outer circumferential surface of the sign-board having the radius R, a mounting board 2 is essentially fixed to the curved surface having the radius R of a curved member 8 through a sheet 4 made of silicone rubber. The curved member 8 is made of an aluminum metal plate (e.g., JIS A5052) having good thermal conductivity to dissipate heat generated by light-emitting elements (to be described later) and has a thickness of about 3 mm. The mounting board 2 is made of a glass-reinforced epoxy resin or the like and has appropriate flexing properties and a thickness of about 1 mm. The sheet 4 has both electrical insulation and thermal conduction. In place of the silicone rubber sheet 4, a silicone rubber layer may be formed in advance on the curved member 8 to a thickness of about 1 to 2 mm.

Each reflector 14 having a concave reflecting surface 14*f* corresponding to high-intensity LED elements 3 is mounted on the mounting board 2. Bored holes 14*b* are formed at four portions of the reflector 14, so that the reflector 14 can be fixed on the mounting board 2 to adhere a filter 15 flat on its surface. Screws 20 are threadably engaged with spring tapping portions 8*f* formed in the curved member 8 through the mounting board 2 and the silicone rubber sheet 4. Portions of the filter 15 other than its light-transmitting transparent hole portions 15*a* are colored in black by printing or the like, so that the respective dots clearly stand out from the transparent hole portions 15*a*.

Each reflector 14 is dividedly formed to have a width of 24 mm which corresponds to ¼ the width L of the mounting board 2. This aims at preventing the reflecting surface 14*f* from becoming an under portion in a mold and at minimizing the mold by using a common component.

Figure 5A:
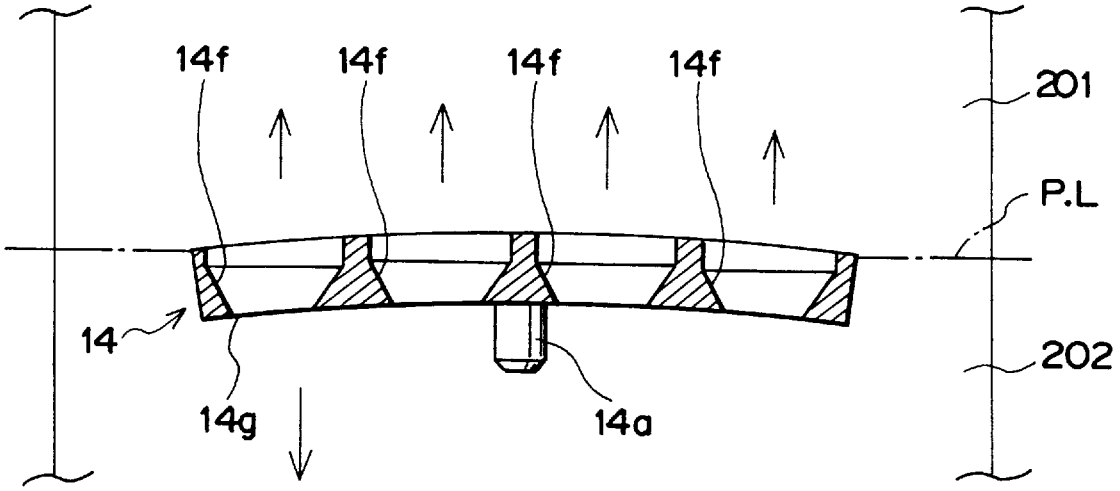
FIG. 5A is a cross-sectional view of convex reflectors.
Figure 5B:
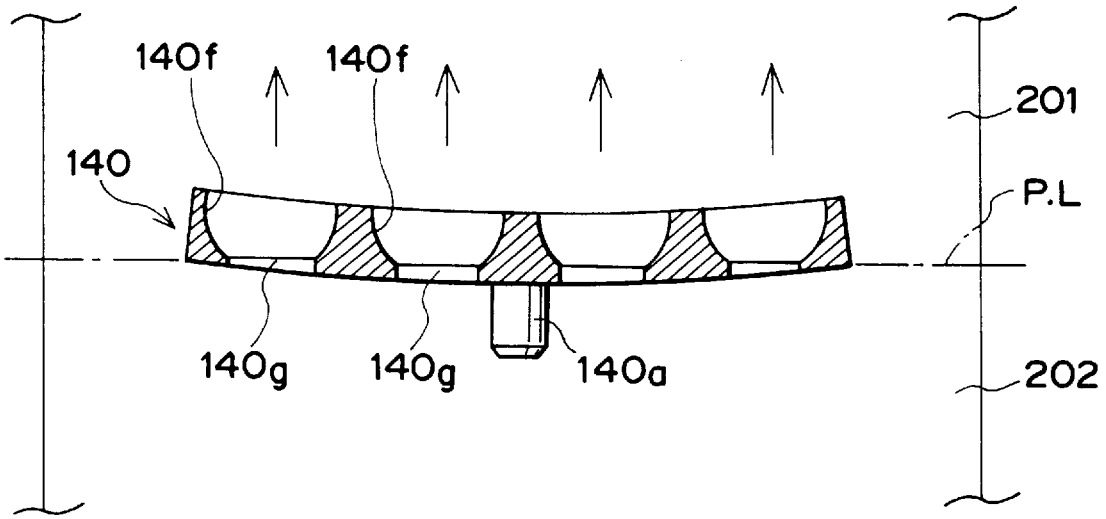
FIG. 5B is a cross-sectional view of concave reflectors.
Figure 6A:
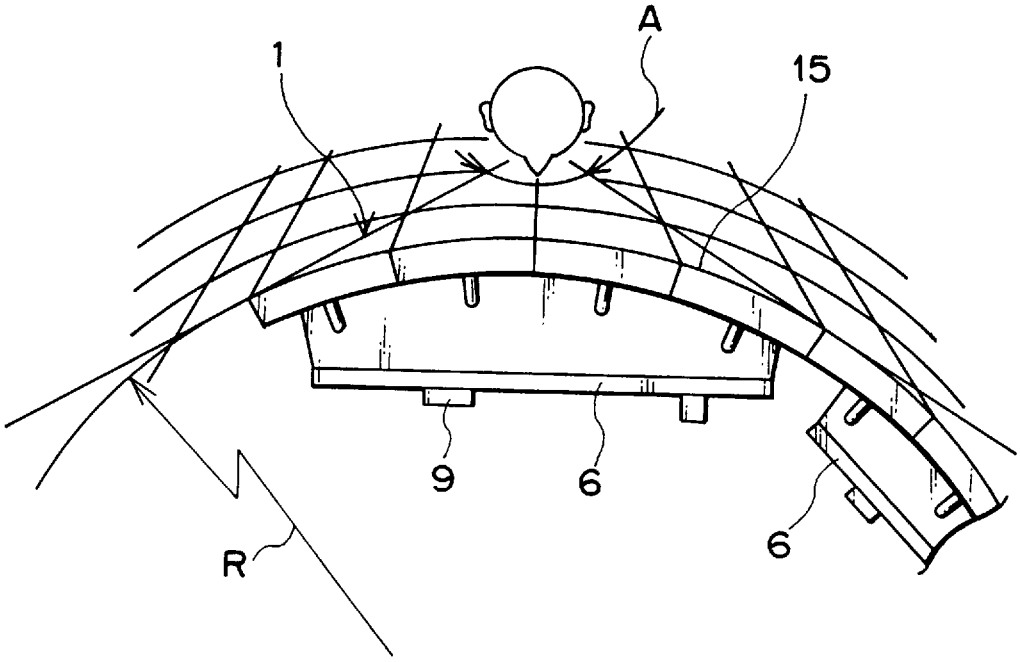
FIG. 6A is a schematic diagram showing a convex sign display unit which is in use.
Figure 6B:
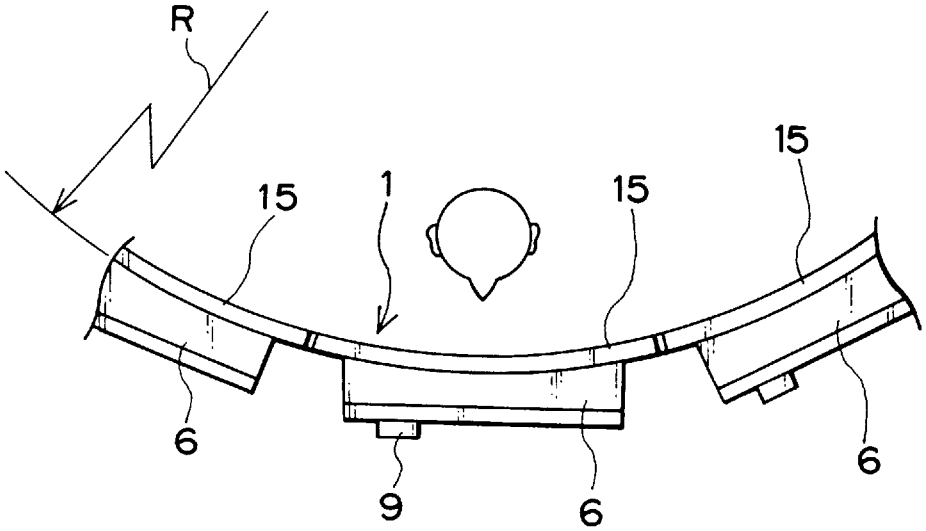
FIG. 6B is a schematic diagram showing a convex sign display unit which is in use.

For this purpose, referring to the main part sectional view of FIG. 5A showing a stationary mold 202 and a movable mold 201 of a mold set together with the convex reflector, four opening portions 14*g* and four substantially parabolic reflecting surfaces 14*f* are formed in the reflector 14. The opening portions 14*g* are formed at positions of the reflector 14 corresponding to the light-emitting elements on the mounting board 2. The reflecting surfaces 14*f* are continuous to the respective opening portions 14*g*. Each of these reflecting surfaces 14*f* is formed such that it will not become a so-called under portion when the stationary mold 202 and the movable mold 201 are moved, after molding, in the mold opening directions of arrows in FIG. 5A. As a result, when the molded product is extracted by opening the stationary mold 202 and the movable mold 201 apart at their parting line PL serving as their contact surface, the molded product can be obtained only by moving the molds in the vertical direction in FIG. 5A. A portion of the reflector 14 which forms a projecting guide portion 14*a* to be described later and which serves as a guide portion when mounting the reflector 14 to the curved member 8 is also molded so as not to become an under portion. A concave reflector 140 is also formed in the same manner. More specifically, referring to the sectional view of FIG. 5B showing the main part of a stationary mold 202 and a movable mold. 201 of a mold set together with the cross-sectional view of the concave reflector, four opening portions 140*g* and four substantially parabolic reflecting surfaces 140*f* are formed in the reflector 140. The opening portions 140*g* are formed at positions of the reflector 140 corresponding to the light-emitting elements on the mounting board 2. The reflecting surfaces 140*f* are continuous to the respective opening portions 140*g*. Each of these reflecting surfaces 140*f* is formed such that it will not become a so-called under portion when the stationary mold 202 and the movable mold 201 are moved, after molding, in the mold opening directions of arrows in FIG. 5B.

When the reflector 14 or 140 is formed in the above manner, the number of molds can be minimized. Regarding the reflector 14 or 140 molded in this manner, one made of a white heat-resistant resin material or one which is molded and subjected to a mirror surface treatment by aluminum deposition or the like is employed. Therefore, sufficient total reflection by the reflecting surfaces 14*f* or 140*f* is assured to emit light toward the filter 15.

Referring back to FIG. 1, a frame 10 fixes a circuit board 6 having connectors 9 mounted thereon. Flat fixing portions 8*a* for fixing the frame 10 with screws 20 (e.g., seams each integrally formed by a spring washer and a plain washer) are formed on the curved member 8 by pressing together with the curved surface. Heat from the curved member 8 is conducted to the frame 10 through the fixing portions 8*a* and is dissipated from heat dissipating holes 10*b* or the like. The fixing portion 8*a* can be fixed to the main body of the apparatus with screw holes 10*a*.

Referring to FIG. 2, a description will be made for only portions that have not been described yet. Mount tabs 10*c* subjected to screw tapping are integrally formed at four corners of the frame 10, so that the circuit board 6 can be fixed to the frame 10. Connecting pins 12 are provided between the mounting board 2 and the driving circuit. End portions 12*a* of the connecting pins 12 are inserted in the through holes of the mounting board 2 and are soldered, thereby obtaining electrical conduction.

Referring to FIG. 3, a description will be made for only portions that have not been described yet. Through holes 6*b* for receiving the screws 20 are formed at the four corners of the circuit board 6. Elongated holes 8*c* are formed in the curved member 8. The plurality of connecting pins 12 soldered to the mounting board 2 are inserted in the elongated holes 8*c*, as shown in FIG. 3, to pass through holes 6*a* on the circuit board 6.

Clearance groove portions 4*d*, clearance hole portions 4*a*, and elongated clearance hole portions 4*c* are formed in the silicone rubber sheet 4 to allow the projecting guide portions 14*a* of the reflectors, machine screws 120, and the connecting pins 12 to pass therethrough respectively. Clearance holes 2*d* and 2*a* are formed in the mounting board 2 having a surface mounted with the light-emitting elements 3, as shown in FIG. 3. The machine screws 120 that are inserted in the bored holes 14*b* of the reflectors 14 and threadably engaged with the spring tapping portions 8*f* of the curved member 8 are passed through the clearance holes 2*a* and clamp the mounting board 2 together with the curved member 8. Thus, the mounting board 2 which originally holds a flat state is brought into tight contact with the curved surface of the curved member 8 and is fixed.

The mounting board 2 is partially fixed in the above manner. The two edge portions of the mounting board 2 are not sometimes firmly fixed. Therefore, clips 7 made of spring steel are provided to the mounting board 2, as shown in FIG. 4. More specifically, one end 7*b* of each clip 7 is caught by the corresponding elongated hole 8*c* while the other end 7*a* thereof is caught on the mounting board 2, thereby preventing the two edge portions of the mounting board 2 from floating by the spring force of the clips 7.

When light-emitting elements in a number corresponding to dots that can display at least a Japanese character or a character including an alpha-numeric character, a graphic pattern, or a pattern similar to this are mounted vertically and horizontally on the sign display unit 1 formed in the above manner, a visual field angle A can be increased. When the sign display unit 1 forms a concave curved surface, natural display quality can be realized.

The above description is based on a monochrome display. In recent years, however, the high-intensity LED elements 3 can display R, G, and B colors and are employed in a large sign display apparatus. In mixing these colors naturally, the arrangement of the LED elements 3 is a significant factor.

Figure 7A:
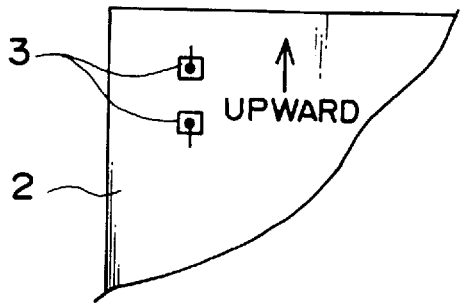
FIGS. 7A to 7F are partially cutaway plan views showing how to mount light-emitting elements.

FIGS. 7A to 7F are partially cutaway plan views showing the mounting of the light-emitting elements. In FIGS. 7A to 7F, a plurality of light-emitting elements of different colors, are mounted in units of dot displays, each of which displays a predetermined dot in the display matrix. In FIG. 7A, two light-emitting elements 3 are mounted at upper and lower portions substantially perpendicular to the surface such that wire bonded to connect the light-emitting elements 3 are directed in the opposite directions.

Figure 7D:
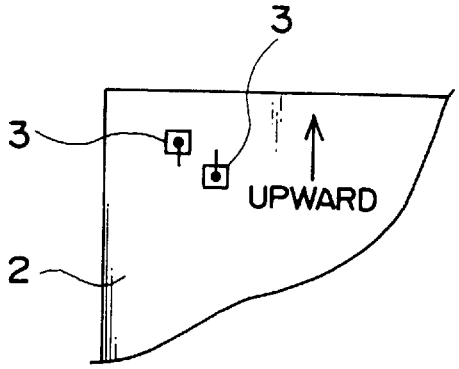
Figure 7B:
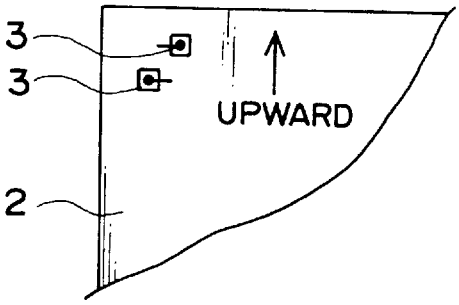

In FIG. 7B, two light-emitting elements 3 are mounted at upper and lower oblique portions with respect to the surface such that wires that connect the light-emitting elements 3 are directed to face each other along the surface.

Figure 7E:
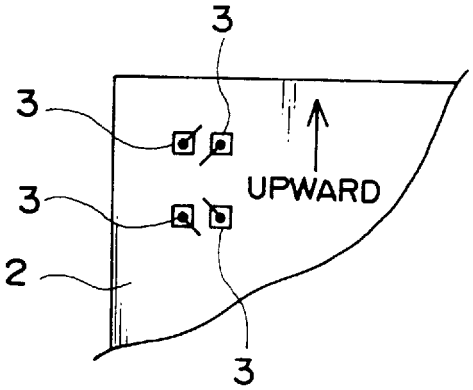
Figure 7C:
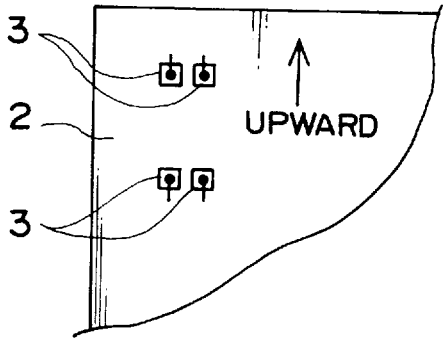

In FIG. 7C, two light-emitting elements 3 are mounted at each of upper and lower portions substantially perpendicular to the surface such that upper and lower wires that connect the light-emitting elements 3 are directed in the opposite directions.

In FIG. 7D, two light-emitting elements 3 are mounted at upper and lower oblique portions with respect to the surface such that wires that connect the light-emitting elements 3 are directed in directions substantially perpendicular to the surface.

In FIG. 7E, two light-emitting elements are mounted at each of the upper and lower portions substantially perpendicular to the surface and upper and lower wires that connect the light-emitting elements 3 at obliquely upper and lower oblique portions with respect to the surface are directed obliquely with respect to the surface.

Figure 7F:
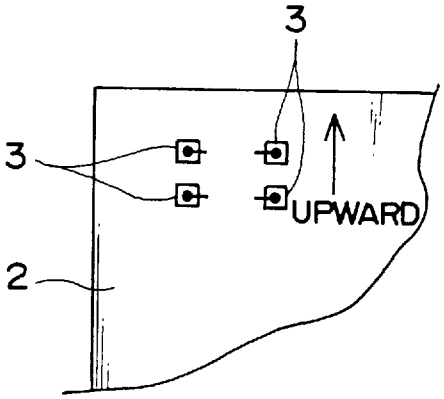

In FIG. 7F, two light-emitting elements 3 are mounted at each of the upper and lower portions substantially perpendicular to the surface and upper or lower wires that connect the light-emitting elements 3 are directed to oppose each other along the surface. The colors are mixed by this arrangement.

In the respective arrangements described above, subtractive mixture of the respective colors is performed upon supplying power to the light-emitting elements in the predetermined manner, and a desired color can be reproduced on the curved surface. According to the above description, high-intensity LED elements 3 are used as the light-emitting elements. However, the light-emitting elements are not limited to the high-intensity LED elements, and various types of light-emitting elements can be employed. The display contents include various types of image information in addition to kanji character information and alpha-numeric character information, and the display contents are appropriately determined according to the application, as a matter of course.

Figure 8A:
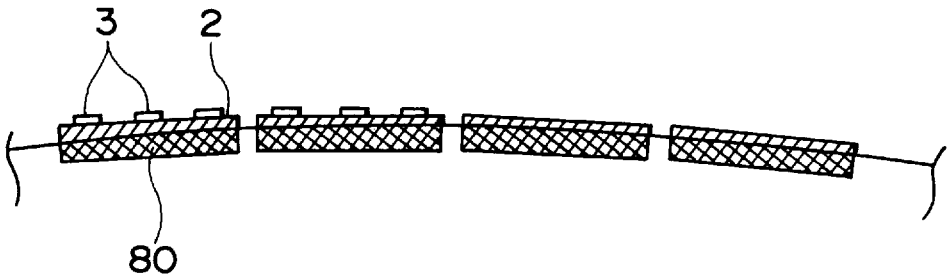
FIGS. 8A to 8C show the mounted states of other embodiments.
Figure 8B:
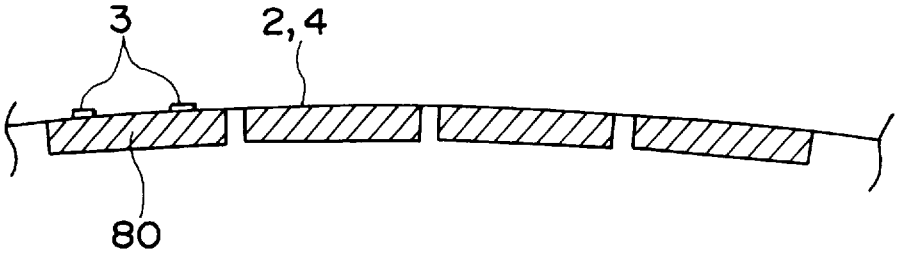
Figure 8C:
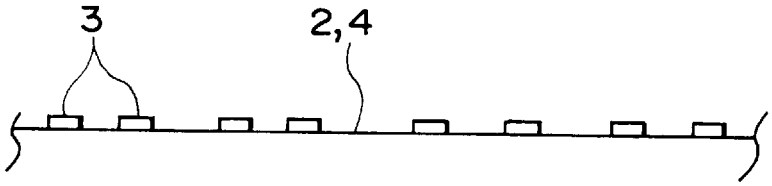

FIGS. 8A, 8B, and 8C are sectional views showing the main parts in which sufficiently flexible boards are used as the mounting boards 2. Referring to FIG. 8A, the board 2 is made of a composite board having a flexible portion made of a polyimide resin or the like. Light-emitting elements 3 are mounted on the mounting board 2, and the mounting board 2 is fixed to aluminum plates 80 through a silicone sheet 4. With this arrangement, the structure can be simplified and made at a low cost.

FIG. 8B shows a case wherein light-emitting elements 3 are mounted on an integral laminate body of a flexible board made of a polyimide resin or the like and a silicone sheet, and aluminum plates 80 are fixed to the lower sides of the integral laminate body. As shown in FIG. 8C, after light-emitting elements 3 are mounted on an integral laminate body of a flexible board 2 made of a polyimide resin or the like and a silicone sheet 4, the integral body may be provided on the curved member described above.

Figure 9:
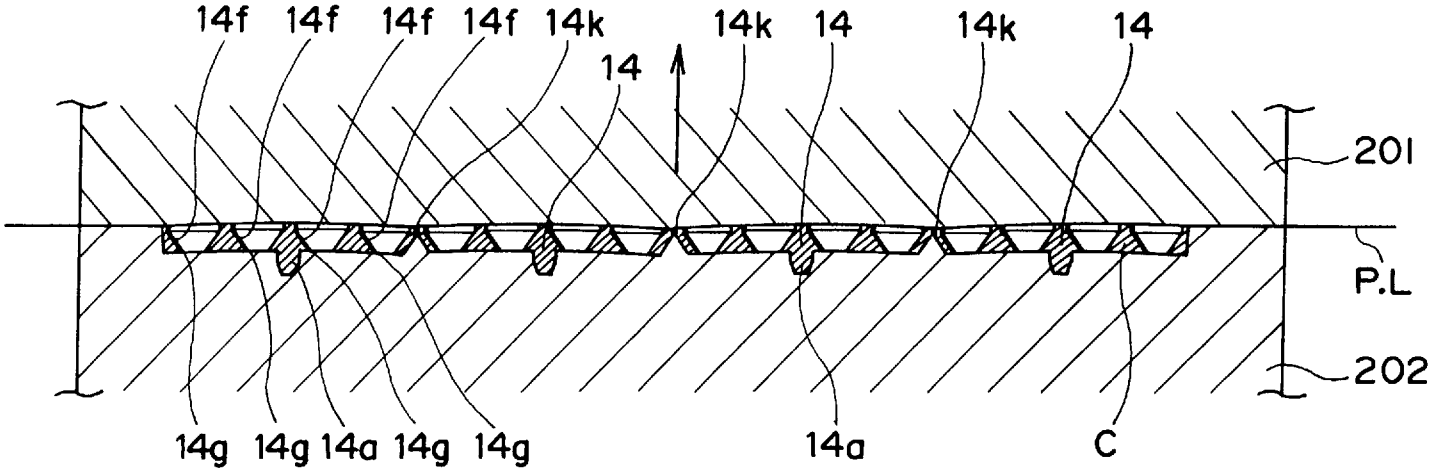
FIG. 9 is a cross-sectional view of reflectors shown together with molds.
Figure 10:
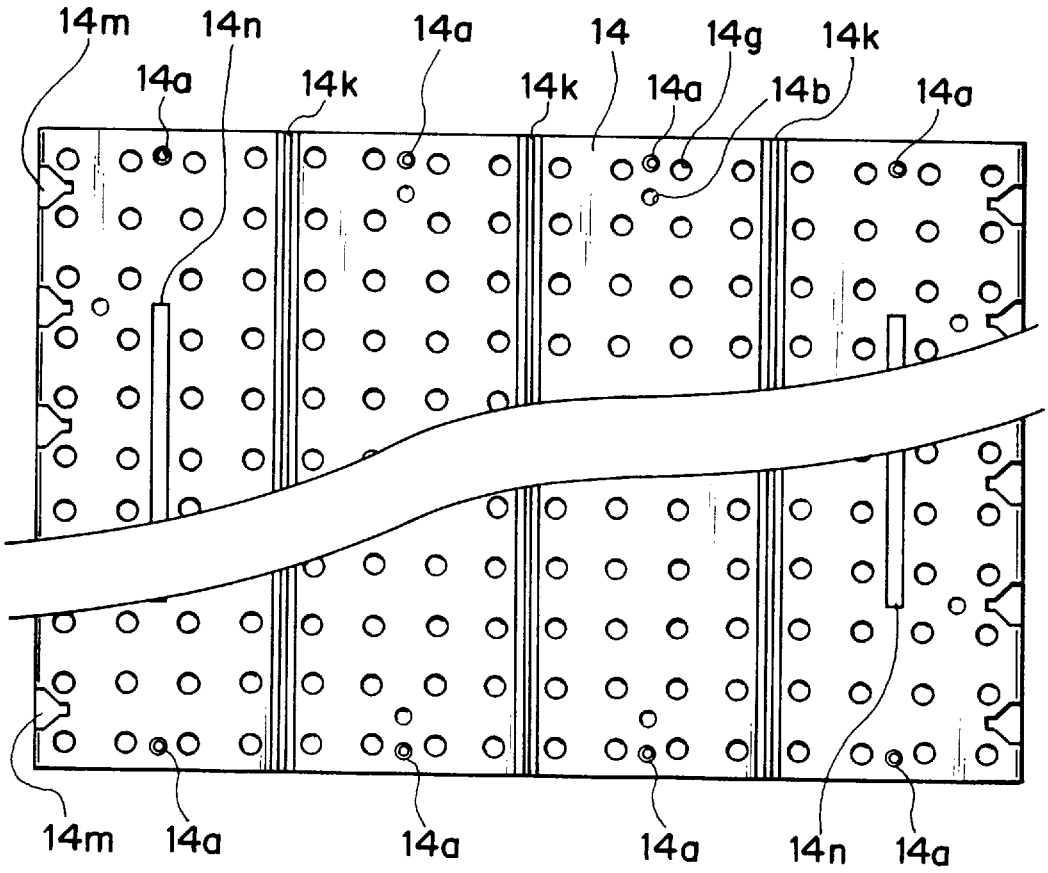
FIG. 10 is a plan view of reflectors 14 seen from the rear surface side.

FIG. 9 is a sectional view showing the main part of the stationary mold 202 and the movable mold 201 of the mold set together with convex reflectors. FIG. 10 is a plan view of reflectors 14 molded by the mold set shown in FIG. 9 and seen from the rear surface side of the light-emitting surfaces.

Referring to FIG. 9, four opening portions 14*g* and four substantially parabolic reflecting surfaces 14*f* are formed in each reflector 14. The opening portions 14*g* are formed at positions of the reflector 14 corresponding to the light-emitting elements on the mounting board 2. The reflecting surfaces 14*f* are continuous to the respective opening portions 14*g*. Four sets of reflectors 14 each of which is constituted in the above manner and which cannot be bent easily are integrally molded such that they are coupled to each other through coupling portions 14*k* that can be bent easily. When the four reflectors 14 are integrally molded in this manner, the assembly process can be improved greatly.

Each of the reflecting surfaces 14*f* of the reflectors 14 integrally molded in this manner is formed such that it will not become a so-called under portion when the stationary mold 202 and the movable mold 201 are moved, after molding, in the mold opening directions of an arrow in FIG. 9. As a result, when the molded product is extracted by opening the stationary mold 202 and the movable mold 201 apart from their parting line PL serving as their contact surface, the molded product can be obtained only by moving the molds in the vertical direction in FIG. 9. The projecting guide portions 14*a* described above are integrally molded at eight portions. Considering the flow of the molten resin injected into a cavity C through a gate (not shown), it is preferable that the coupling portions 14*k* be continuously formed in the longitudinal direction, as shown in FIG. 9. However, the coupling portions 14*k* need not always be formed continuously, but can be provided intermittently at a predetermined pitch. In this case, the reflectors 14 can be bent easily at the coupling portions 14*k*.

Referring to FIG. 10, to form the reflectors 14, white polypropylene, ACS, a resin material such as ABS resin, or a white polycarbonate resin having good heat resistance and a high reflectance is used. Since only the coupling portions 14*k* are bent as described above, a resin different from that of other portions is locally injected to the coupling portions 14*k*. When the reflectors 14 are integrally molded by a two-color mold, a higher degree of freedom of the molding condition can be achieved. Alternatively, heat-resistant sheet members may be set in advance in cavities corresponding to the molding portions of the coupling portions 14*k*.

Figure 11A:
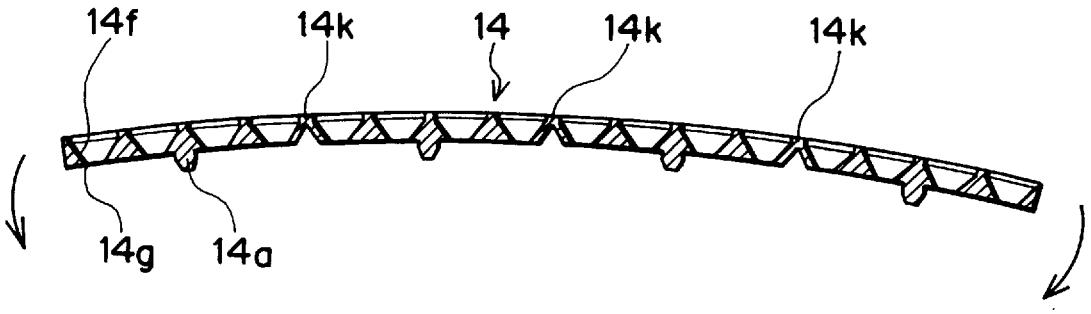
FIG. 11A is a cross-sectional view showing the reflectors 14 which are in use.
Figure 11B:
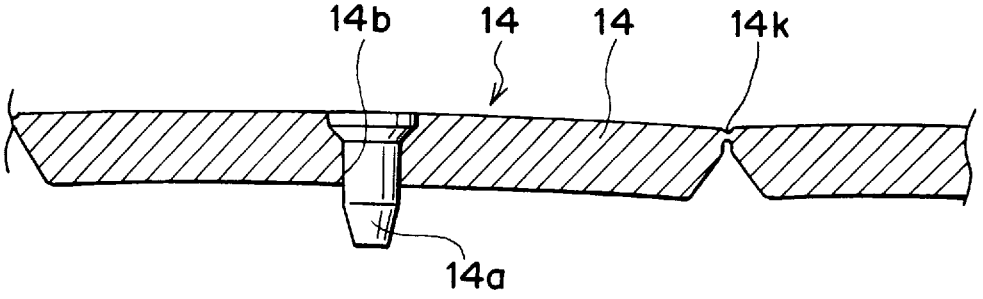
FIG. 11B is a sectional view of the main part of a reflector.

FIG. 11A is a sectional view showing how to fix the reflectors 14 obtained by resin molding of FIG. 9, and FIG. 11B is an enlarged sectional view of the main part of a reflector 14.

Referring to FIGS. 11A and 11B, before the reflectors 14 are bent in the manner as shown in FIG. 11A, all the projecting guide portions 14*a* are fitted in the clearance holes 2*d* of the mounting board 2 on which the LED elements are mounted in advance. Thereafter, the silicone rubber sheet 4 is interposed, and while the reflectors 14 are positioned by using projecting portions 8*k* and guide grooves 8*d* (to be described later) of the curved member 8, the reflectors 14 are bent at the coupling portions 14*k* such that they extend along the curved surface of the curved member 8. Then, the reflectors 14 are fixed to the spring tapping portions 8*f* of the curved member 8 with the flush screws 120 serving as the self-tapping screws. The fixing operation is ended in the above manner.

Figure 12A:
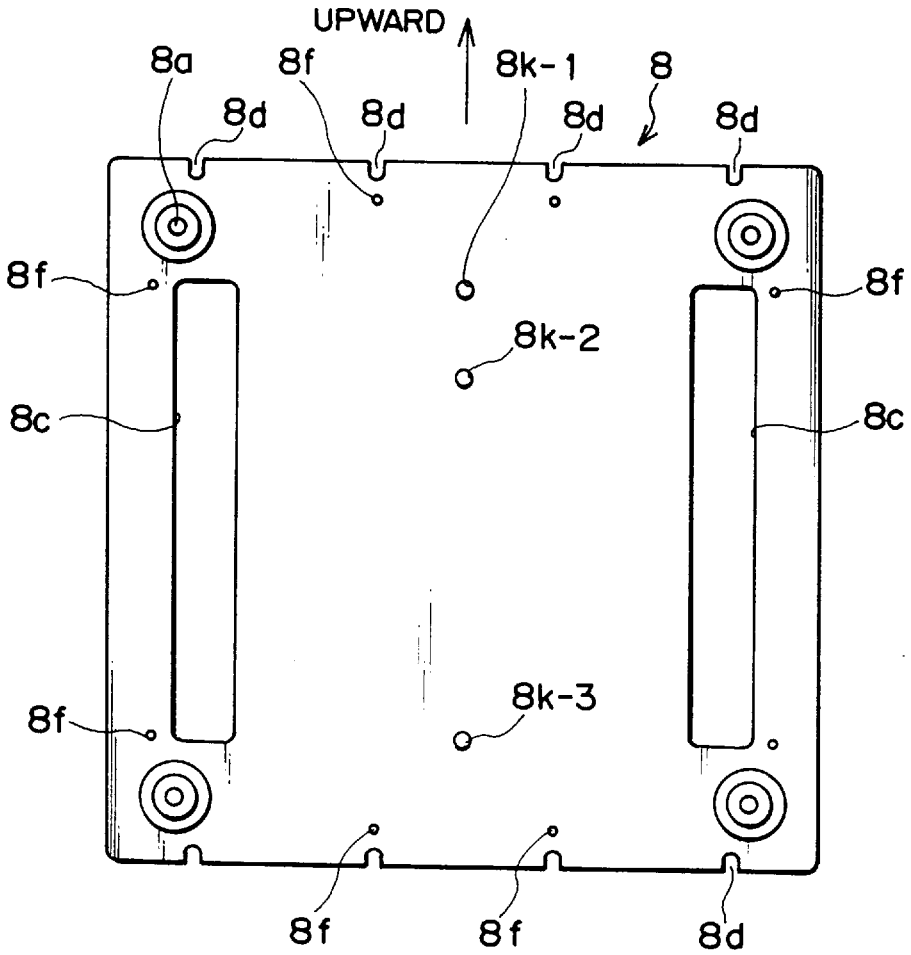
FIGS. 12A and 12B are plan and side views, respectively, of a curved member 8.
Figure 12B:
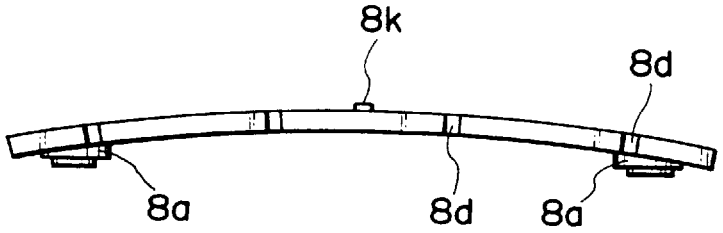

FIG. 12A is a plan view of the curved member 8, and FIG. 12B is a side view of the curved member 8. Referring to FIGS. 12A and 12B, portions identical to those that have already been explained are denoted by the same reference numerals to avoid a repetitive description, and a description will be limited to those that are not explained yet. Projecting portions 8*k*-1, 8*k*-2, and 8*k*-3 defining the vertical relationship and used for positioning are formed at the central portion of the curved surface of the curved member 8 at positions shown in FIG. 12A by half blanking. A surface of the curved member 8 which is to be mounted to the frame 10 is subjected to two-and-half blanking, as shown in FIGS. 12A and 12B, so that a crack and the like will not occur due to the sharp formation. As the spring tapping portions 8*f* are formed in the curved surface, it is difficult to form them as threaded portions, and the spring tapping portions 8*f* are thus formed as clearance holes. Screw threads are formed on the spring tapping portions 8*f* when the flush screws 120 serving as the self-tapping screws are rotated.

Figure 13A:
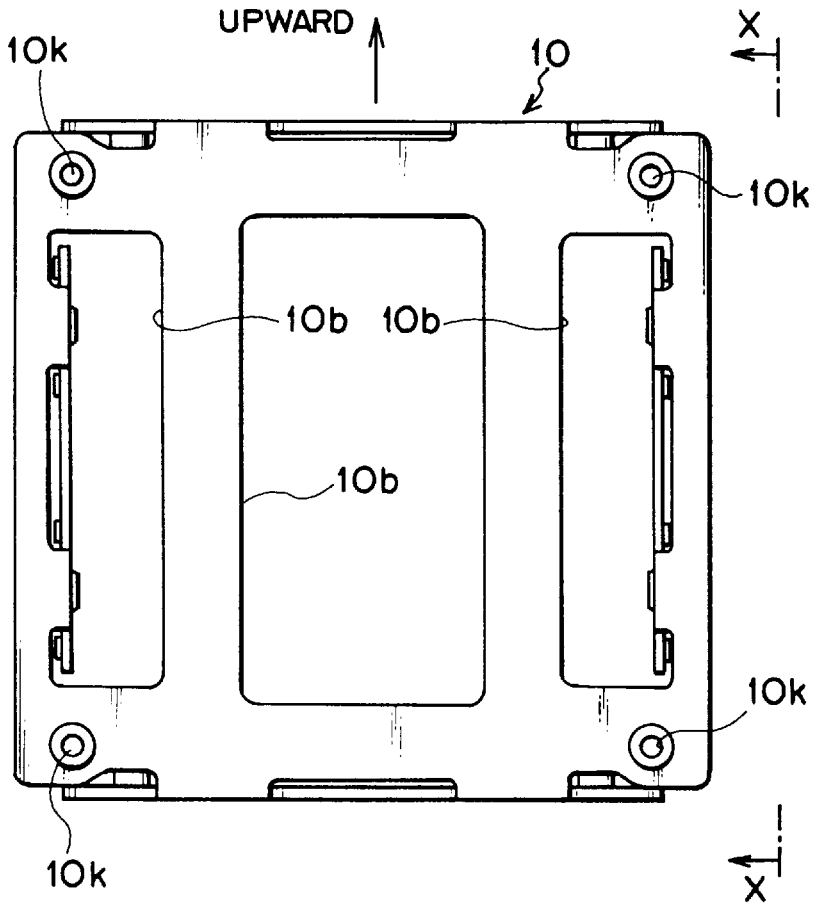
FIG. 13A and 13B are front and side views, respectively, of a body frame 10.
Figure 13B:
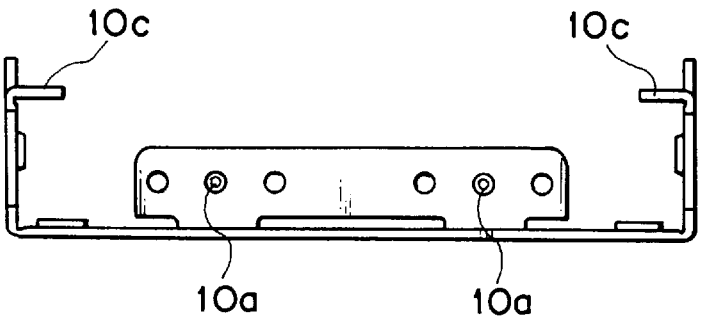

FIG. 13A is a front view of the frame 10, and FIG. 13B is a side view seen from the direction of arrows X—X of FIG. 13A. Referring to FIGS. 13A and 13B, portions identical to those that have already been explained are denoted by the same reference numerals to avoid a repetitive description, and a description will be limited to those that are not explained yet. The tabs 10*c*, for fixing the drive circuit board 6 with screws, are subjected to screw tapping in advance. Thus, when the board 6 is to be fixed by screwing, unnecessary external force will not act on the circuit board 6. The mount screw holes 10*a* are formed in the upper and lower surfaces and right and left side surfaces of the frame 10, as shown in FIGS. 13A and 13B, to facilitate mounting in the vertical direction. Meanwhile, projecting portions and female screw holes are formed in the upper and lower surfaces and right and left side surfaces of the frame 10 by half blanking, so that the multi-stage display apparatus can be formed easily.

Figure 14A:
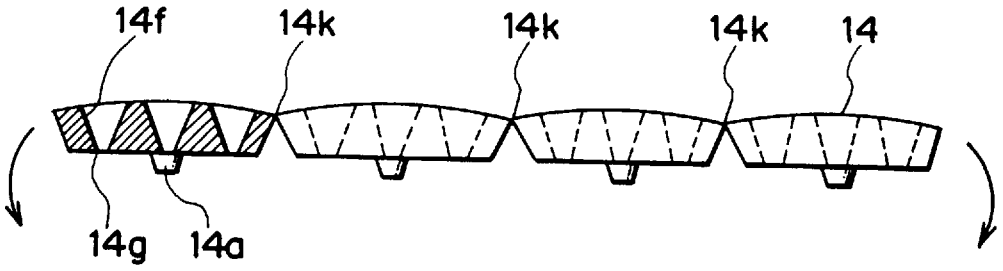
FIGS. 14A to 14C are partial sectional side views of other reflectors.
Figure 14B:
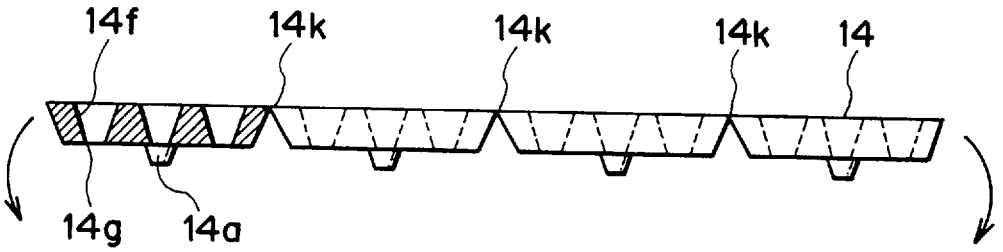
Figure 14C:
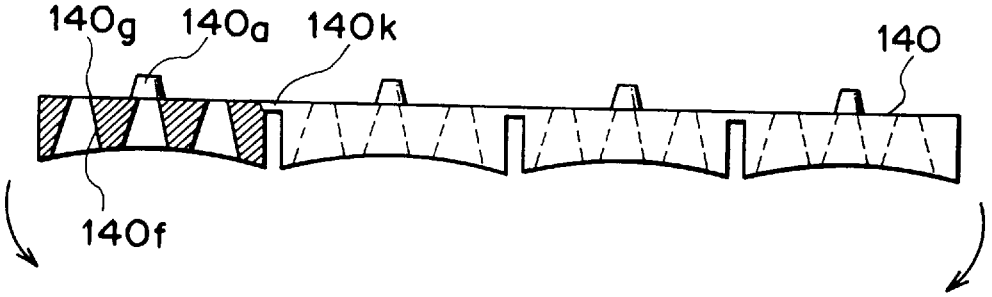
Figure 15:
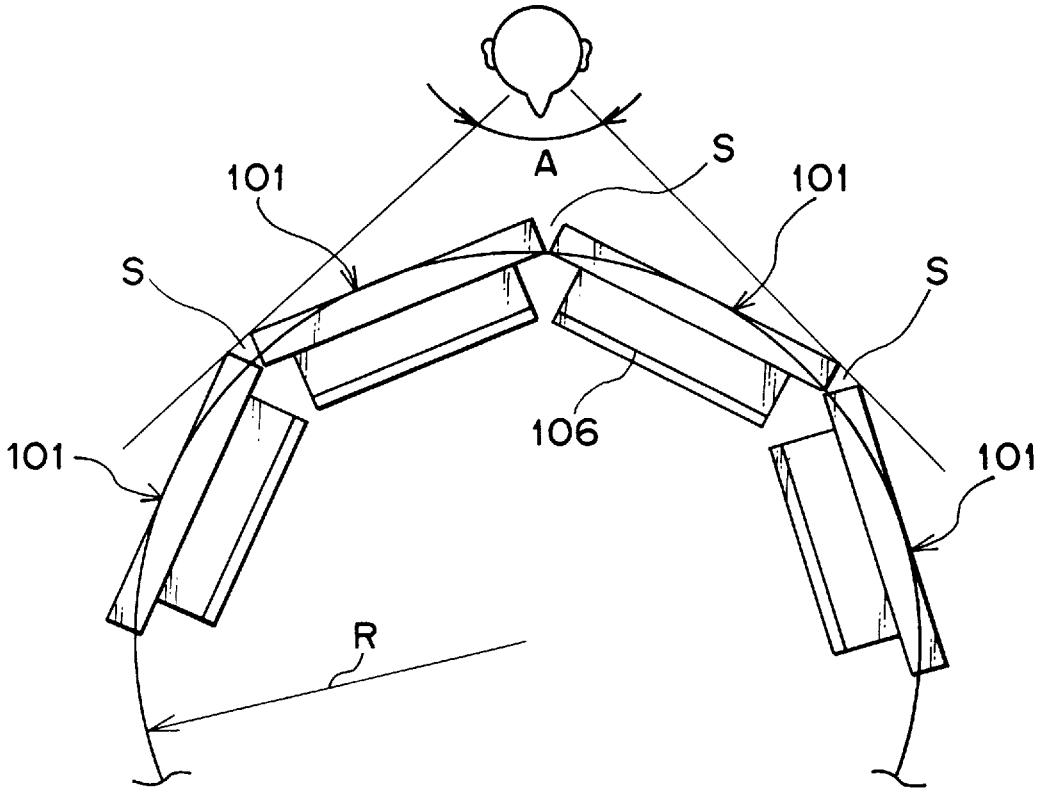
FIG. 15 (PRIOR ART)
FIG. 15 is a plan view of a conventional sign display unit which is arranged on a convex arc having a radius R.

FIGS. 14A to 14C are side views of other reflectors 14 and 140. FIG. 14A shows the reflectors 14 used when the curved member 8 is constituted by a polygon. As shown in FIG. 14A, the surfaces of the reflectors 14 integrally formed with projecting guide portions 14*a* are flat surfaces, and are integrally formed with each other through coupling portions 14*k* so that only their light-emitting surfaces are curved. FIG. 14B shows the reflectors 14 used when a curved member 8 is constituted by a polygon. As shown in FIG. 14B, both the surfaces of the reflectors 14 integrally formed with projecting guide portions 14*a* and the light-emitting surfaces of the reflectors 14 are flat surfaces. FIG. 14C shows the reflector 140 used when a curved member 8 is curved in a concave manner. As shown in FIG. 14C, the surfaces of the reflector 140 integrally formed with projecting guide portions 14*a* are flat surfaces, and are integrally formed with each other through coupling portions 140*k* so that only their light-emitting surfaces are curved in the concave manner.

As has been described above, according to the present invention, there is provided a sign display unit in which, when it is used in the form of a plurality of units arranged adjacent to each other along at least one surface to form a convex or concave arc curved surface with a predetermined radius, thus displaying desired sign information, good readability is provided by increasing the visual field angle without degrading the display quality.

According to the present invention, there is also provided a sign display unit in which, when it is used in the form of a plurality of units arranged adjacent to each other at least along one surface to form a convex or concave annular curved surface with a radius of 10 cm or more, thus displaying desired sign information including kanji character information, good readability is provided by increasing the visual field angle without degrading the display quality, and the constituent components including reflectors and the like can be manufactured at a low cost.

According to the present invention, there is also provided a large sign-board in various types of large public facilities, that can effectively reproduce colors obtained by mixing light-emitting colors and provides good readability by increasing the visual field angle without degrading the display quality.

According to the present invention, there is also provided a sign display unit in which, when it is used in the form of a plurality of units arranged adjacent to each other along at least one surface to form a convex or concave arc curved surface with a predetermined radius, thus displaying desired sign information, an image that can be visually recognized from, e.g., any direction of 360° is provided.

According to the present invention, in a large sign-board, light-emitting elements of different colors are appropriately arranged adjacent to each other at the respective dots, thereby providing a sign display unit that can effectively reproduce colors obtained by a color mixture of the light-emitting elements of different colors while increasing a visual field angle.

According to the present invention, there is also provided a sign display unit in which, when it is used in the form of a plurality of units arranged adjacent to each other along at least one surface to form a convex or concave arc curved surface with a predetermined radius, thus displaying desired sign information, good readability is provided by increasing the visual field angle without degrading the display quality, the constituent components can be manufactured at a low cost, and the manufacturing cost can be decreased.

As many apparently widely different embodiments of the present invention can be made without departing from the spirit and scope thereof, it is to be understood that the invention is not limited to the specific embodiments thereof except as defined in the appended claims.

What is claimed is:

1. Sign display apparatus comprising: a plurality of sign display units arranged adjacent to each other to form a display surface having a convex curvature, each of said units including:

a frame base portion;

a curved member fixed to said frame base portion;

a mounting board being fixed to said curved member and having light-emitting elements mounted thereon which are used for a sign display of a predetermined dot matrix, said units providing for said light-emitting diodes to be located at equal intervals with respect to one another on said display surface; and a circuit board fixed to said frame base portion and connected to said mounting board to control light emission of said light-emitting elements.

2. The apparatus according to claim 1, wherein said mounting board is flexible in the form of a plurality of boards arranged adjacent to each other and formed as a convex arc curved surface with a predetermined radius, said flexible mounting board mounting said light-emitting elements thereon in vertical and horizontal directions in a predetermined dot matrix, and one of a heat-conductive insulating layer and a heat-conductive insulator having both thermal conductivity and electrical insulation and which dissipates heat generated by said light-emitting elements and which is fixed between said curved member and said flexible mounting board.

3. The apparatus according to claim 2, wherein said one of heat-conductive insulating layer and said heat-conductive insulator is a silicone resin layer or a silicone rubber sheet, said curved member being formed of a heat-conductive plate of a predetermined number of curved members to form part of an annular outer circumferential surface having a radius of not less than 10 cm.

4. The apparatus according to claim 2, comprising a reflector and fixing means for fixing said reflector having concave reflecting surfaces on said mounting board, said concave reflecting surfaces being provided in correspondence with said light-emitting elements mounted on said mounting board, and wherein said reflector is dividedly formed with members each having a width obtained by dividing an entire length of said mounting board along said curved surface by an integer, said reflector being injection-molded of a predetermined resin material such that said reflecting surfaces are prevented from becoming an under side or portion in a mold.

5. Sign display apparatus comprising: a plurality of sign display units arranged adjacent to each other along a circular convex outer curve, each of said units including:

a frame base portion;

a flexible mounting board on which light-emitting elements corresponding to dots that can display at least a character, a graphic pattern, or a pattern are mounted in vertical and horizontal directions in a matrix;

a curved member which fixes said mounting board along a curved surface in tight contact through a silicone resin layer or a silicone rubber sheet having both thermal conductivity and electrical insulation, which has a flat fixing portion to fix a circuit board, and which dissipates heat generated by said light-emitting elements;

said circuit board being connected to said mounting board to drive said light-emitting elements in a predetermined manner; and a reflector and fixing means for fixing said reflector on said mounting board, said reflector having concave reflecting surfaces formed in correspondence with said light-emitting elements mounted on said mounting board, wherein said reflector is dividedly formed with members each having a width obtained by dividing an entire length of said mounting board along said surface by an integer.

6. Sign display apparatus, comprising: a plurality of sign display units arranged adjacent to each other in vertical and horizontal directions to form an arc or circular curve in a convex manner, each of said units including:

a flexible mounting board on which light-emitting elements are mounted in the vertical and horizontal directions in a dot matrix of a predetermined unit of display and which emit light of predetermined colors;

a curved member which fixes said mounting board along a curved surface in tight contact through a heat-conductive insulating layer or a heat-conductive insulator having both thermal conductivity and electrical insulation, and which dissipates heat generated by said light-emitting elements; and a circuit board connected to said mounting board to drive said light-emitting elements in a predetermined manner, wherein said light-emitting elements include a plurality of different-color light-emitting elements mounted on said mounting board at dots, according to at least one of:

two light-emitting elements are mounted at upper and lower portions respectively, substantially perpendicular to said surface such that wires that connect said light-emitting elements are directed in opposite directions, two light-emitting elements are mounted at upper and lower oblique portions with respect to said surface such that wires that connect the light-emitting elements are directed to face each other along said surface, two light-emitting elements are mounted at each of upper and lower portions substantially perpendicular to said surface such that upper and lower wires that connect said light-emitting elements are directed in the opposite directions, two light-emitting elements are mounted at upper and lower oblique portions with respect to said surface such that wires that connect said light-emitting elements are directed in directions substantially perpendicular to said surface, and two light-emitting elements are mounted at each of upper and lower portions substantially perpendicular to said surface and upper or lower wires that connect said light-emitting elements are directed to oppose each other along said surface.

7. Sign display apparatus, comprising a plurality of sign display units arranged adjacent to each other to form a display having a convex curvature, each of said units including:

a frame base portion;

a flexible mounting board on which light-emitting elements forming a predetermined dot matrix are mounted in vertical and horizontal directions;

a curved member having a curved surface and being fixed to said frame base portion, said curved member serving to fix said mounting board in tight contact through a heat-conductive insulating layer or a heat-conductive insulator having both thermal conductivity and electrical insulation, thereby dissipating heat of said light-emitting elements;

a circuit board connected to said mounting board to drive said light-emitting elements in a predetermined manner and fixed to said frame base portion; and a reflector which is dividedly formed with unitary portions each having a width obtained by dividing a length of said curved surface by an integer, said reflector being injection-molded with a predetermined resin material to have reflecting surfaces corresponding to said light-emitting elements, so that said reflecting surfaces are prevented from becoming an under portion in a mold, said reflector being integrally molded with coupling portions coupling said unitary portions.

8. The apparatus according to claim 7, wherein said coupling portions are molded of a resin material which is different from the predetermined resin material.

9. The apparatus according to claim 7, wherein said reflector is integrally molded to have a guide projecting portion and a hole portion for a set screw, said guide projecting portion capable of being fitted with a positioning portion formed in said curved member.

10. Sign display apparatus, comprising: a plurality of sign display units arranged adjacent to each other to form a display having a shape of a convex polygon, said plurality of units corresponding to respective sides of said polygon, each of said units including:

a frame base portion;

a flexible mounting board on which light-emitting elements used for a sign display of a predetermined dot matrix are mounted in vertical and horizontal directions;

a curved member having a surface and serving to fix said mounting board in tight contact through a heat-conductive insulating layer or a heat-conductive insulator having both thermal conductivity and electrical insulation, thereby dissipating heat of said light-emitting elements;

a circuit board connected to said mounting board to drive said light-emitting elements in a predetermined manner and fixed to said frame base portion; and a reflector which is dividedly formed with unitary portions each having a width corresponding to a width of each of said sides, said reflector being injection-molded with a predetermined resin material to have reflecting surfaces corresponding to said light-emitting elements, so that said reflecting surfaces are prevented from becoming an under portion in a mold, said reflector being integrally molded with coupling portions coupling said unitary portions.

11. Sign display apparatus, comprising: a plurality of sign display units arranged adjacent to each other to form a display surface with a concave curvature, each of said units including:

a frame base portion;

a curved member fixed to said frame base portion:

a mounting board being fixed to said curved member and having light-emitting elements mounted thereon which are used for a sign display of a predetermined dot matrix, said units providing for said light-emitting diodes to be located at equal intervals with respect to one another on said display surface; and a circuit board fixed to said frame base portion and connected to said mounting board to control light emission of said light-emitting elements.

12. The apparatus according to claim 11, wherein the mounting board is flexible in the form of a plurality of boards arranged adjacent to each other and formed as a concave arc curved surface curved with a predetermined radius, said flexible mounting board mounting said light-emitting elements thereon in vertical and horizontal directions in a predetermined dot matrix, and one of a heat-conductive insulating layer and a heat-conductive insulator having both thermal conductivity and electrical insulation and which dissipates heat generated by said light-emitting elements and which is fixed between said curved member and said flexible mounting board.

13. The apparatus according to claim 12, wherein said one of heat-conductive insulating layer and said heat-conductive insulator is a silicone resin layer or a silicone rubber sheet, said curved member being formed of a heat-conductive plate of a predetermined number of curved members to form part of an annular outer circumferential surface having a radius of not less than 10 cm.

14. The apparatus according to claim 12, comprising a reflector and fixing means for fixing said reflector having concave reflecting surfaces on said mounting board, said concave reflecting surfaces being provided in correspondence with said light-emitting elements mounted on said mounting board, and wherein said reflector is dividedly formed with members each having a width obtained by dividing an entire length of said mounting board along said curved surface by an integer, said reflector being injection-molded of a predetermined resin material such that said reflecting surfaces are prevented from becoming an under side or portion in a mold.

15. Sign display apparatus, comprising: a plurality of sign display units arranged adjacent to each other along a circular convex outer curve, each of said units including:

a frame base portion;

a flexible mounting board on which light-emitting elements corresponding to dots that can display at least a character, a graphic pattern or a pattern are mounted in vertical and horizontal directions in a matrix;

a curved member which fixes said mounting board along a curved surface in tight contact through a silicone resin layer or a silicone rubber sheet having both thermal conductivity and electrical insulation, which has a flat fixing portion to fix a circuit board and which dissipates heat generated by said light-emitting elements;

said circuit board being connected to said mounting board to drive said light-emitting elements in a predetermined manner; and a reflector and fixing means for fixing said reflector on said mounting board, said reflector having concave reflecting surfaces formed in correspondence with said light-emitting elements mounted on said mounting board, wherein said reflector is dividedly formed with members each having a width obtained by dividing an entire length of said mounting board along said surface by an integer.

16. Sign display apparatus, comprising: a plurality of sign display units arranged adjacent to each other in vertical and horizontal directions to form an arc or circular curve in a convex manner, each of said units including:

a flexible mounting board on which light-emitting elements are mounted in the vertical and horizontal directions in dot matrix of a predetermined unit of display and which emit light of predetermined colors;

a curved member which fixes said mounting board along a curved surface in tight contact through a heat-conductive insulating layer or a heat-conductive insulator having both thermal conductivity and electrical insulation and which dissipates heat generated by said light-emitting elements; and a circuit board connected to said mounting board to drive said light-emitting elements in a predetermined manner, wherein said light-emitting elements include a plurality of different-color light-emitting elements mounted on said mounting board at dots, according to at least one of:

two light-emitting elements are mounted at upper and lower portions respectively substantially perpendicular to said surface such that wires that connect said light-emitting elements are directed in opposite directions, two light-emitting elements are mounted at upper and lower oblique portions with respect to said surface such that wires that connect the light-emitting elements are directed to face each other along said surface, two light-emitting elements are mounted at upper and lower oblique portions with respect to said surface such that wires that connect said light-emitting elements are directed in directions substantially perpendicular to said surface, two light-emitting elements are mounted at each of upper and lower portions substantially perpendicular to said surface and upper and lower wires that connect said light-emitting elements at upper and lower oblique portions with respect to said surface are directed obliquely with respect to said surface, and two light-emitting elements are mounted at each of upper and lower portions substantially perpendicular to said surface and upper or lower wires that connect said light-emitting elements are directed to oppose each other along said.

17. Sign display apparatus, comprising: a plurality of sign display units arranged adjacent to each other to form a display having a convex curvature, each of said units including:

a frame base portion;

a flexible mounting board on which light-emitting elements forming a predetermined dot matrix are mounted in vertical and horizontal directions;

a curved member having a curved surface and being fixed to said frame base portion, said curved member serving to fix said mounting board in tight contact through a heat-conductive insulating layer or a heat-conductive insulator having both thermal conductivity and electrical insulation, thereby dissipating heat of said light-emitting elements;

a circuit board connected to said mounting board to drive said light-emitting elements in a predetermined manner and fixed to said frame base portion, and a reflector which is dividedly formed with unitary portions each having a width obtained by dividing a length of said curved surface by an integer, said reflector being injection-molded of a predetermined resin material and having reflecting surfaces corresponding to said light-emitting elements, so that said reflecting surfaces are prevented from becoming an under portion in a mold, said reflector being integrally molded with coupling portions coupling said unitary portions.

18. The apparatus according to claim 17, wherein said coupling portions are molded of a resin material which is different from the predetermined resin material.

19. The apparatus according to claim 17, wherein said reflector is integrally molded to have a guide projecting portion and a hole portion for a set screw, said guide projecting portion capable of being fitted with a positioning portion formed in said curved member.

20. Sign display apparatus, comprising: a plurality of sign display units arranged adjacent to each other to form a display having a shape of a concave polygon, said plurality of units corresponding to respective sides of said polygon, each of said units including:

a frame base portion;

a flexible mounting board on which light-emitting elements used for sign display of a predetermined dot matrix are mounted in vertical and horizontal directions;

a curved member having a surface and serving to fix said mounting board in tight contact through a heat-conductive insulating layer or a heat-conductive insulator having both thermal conductivity and electrical insulation, thereby dissipating heat of said light-emitting elements;

a circuit board connected to said mounting board to drive said light-emitting elements in a predetermined manner and fixed to said frame base portion; and a reflector which is dividedly formed with unitary portions each having a width corresponding to a width of sides of said concave polygram, said reflector being injection-molded of a predetermined resin material and having reflecting surfaces corresponding to said light-emitting elements, so that said reflecting surfaces are prevented from becoming an under portion in a mold, said reflector being integrally molded with coupling portions coupling said unitary portions.

* * * * *